United States Patent [19]

Uppvall

[11] 4,303,244

[45] Dec. 1, 1981

[54] METHOD FOR DETECTING GOLFER'S HEAD MOVEMENT WHEN PUTTING

[76] Inventor: Charles P. Uppvall, 453 Clapboardtree St., Westwood, Mass. 02090

[21] Appl. No.: 233,022

[22] Filed: Feb. 9, 1981

[51] Int. Cl.[3] ..... A63B 69/36

[52] U.S. Cl. ..... 273/183 B; 273/183 E; 273/DIG. 17; 434/252

[58] Field of Search ..... 273/183 R, 183 B, 183 E, 273/190 R, 190 A; 434/252

[56] References Cited

U.S. PATENT DOCUMENTS

| | | | |
|---|---|---|---|
| 2,330,442 | 9/1943 | Nero | 273/183 B X |
| 3,309,691 | 3/1967 | Bonanno | 273/DIG. 17 |
| 3,811,684 | 5/1974 | Tredway, Sr. | 273/183 B |
| 4,079,940 | 3/1978 | Arakaki | 273/183 E X |

FOREIGN PATENT DOCUMENTS

| | | | |
|---|---|---|---|
| 430844 | 6/1935 | United Kingdom | 273/183 E |

*Primary Examiner*—George J. Marlo
*Attorney, Agent, or Firm*—William Nitkin

[57] ABSTRACT

A golf putting training device comprised of a cap with light emittor adapted to project a spot beam of light to a first position before a golfer putts, said spot to be observed by the golfer immediately after putting to see if the spot beam is in a second position, the distance between the first and second position indicating improper movement of the head of the golfer during putting.

1 Claim, 3 Drawing Figures

METHOD FOR DETECTING GOLFER'S HEAD MOVEMENT WHEN PUTTING

BACKGROUND OF THE INVENTION

1. Field of the Invention

The apparatus of this invention resides in the field of training devices and more particularly relates to a golf putting training device to help train a player to keep his head in a stationary position when putting.

2. History of the Prior Art

Many golfing aids have been developed over the years such as masking devices to limit the golfer's view, pendulum-like devices hanging from the golfer for assisting a golfer in maintaining a proper posture and light emitting devices of the type having light emanate upwards through the tee for the golfer to keep his eyes on after putting, or light emanating from the striking face of the putter to show the proposed direction of the ball when struck by the putter, or light emanating from a golf glove for the user to follow the patterns of light on a wall surface to determine if he is using proper arm movements in his golf swing. Examples of U.S. Patents in this area are:

U.S. Pat. No. Re. 28,661—Tredway, Sr.
U.S. Pat. No. 3,437,339—Starck
U.S. Pat. No. 3,545,764—Broderick
U.S. Pat. No. 3,707,291—Tredway
U.S. Pat. No. 3,826,502—Sorge
U.S. Pat. No. 3,899,180—Rodman
U.S. Pat. No. 3,951,414—Nunez
U.S. Pat. No. 3,992,011—Jessee
U.S. Pat. No. 4,042,236—Le Prevost
U.S. Pat. No. 4,063,740—Mader

SUMMARY OF THE INVENTION

Many golfers when putting keep their eyes on the ball and hence move their heads to follow the balls' path of travel. This procedure is felt to cause inaccurate putting and it is considered desirable for the golfer when putting to keep his head and eyes downward after putting the ball, holding his head steady and focusing his eyes on the spot from where the ball is struck until the ball is well on its way toward the hole. The movement of one's head is difficult to prevent upon striking the ball in putting because some movement appears to occur naturally. Golfers try many practice techniques to try to avoid moving their heads to follow the path of the ball, but it is very difficult for a golfer to determine if he is moving his head and "peeking" after the ball to watch its travel, and many golfers cannot determine on their own if they are performing this error in technique. Therefore the device of this invention can enable a golfer to determine if he is making this error in technique and to assist him in improving his technique.

The device of this invention includes an adjustable headpiece designed to fit on the head of the golfer and to be held snugly in place. Part of the unit contains a forwardly shining light member which has, like a flashlight, a light bulb with an electrical power source such as a flashlight battery with means to turn it on and off such as an on off switch. When the light of this headpiece is turned on, the light beam produced is adapted to be aimed onto the putting surface near the ball where the golfer has assumed a normal putting stance. The position of the light beam may be adjustable by movement of a reflector by control means as described below so as to accommodate each golfer. The device of this invention can be used on outdoor putting greens or in the home such as on a rug or carpet or anywhere that is smooth and may approximate the surface of a putting green. The golfer proceeds as he would normally putt with a golfball on a putting surface. He turns the light on causing a beam of light to be focussed on the putting surface near the ball when he assumes his normal putting stance. Before the player putts the ball, he would go through his normal pre-putting practice which may include several swings or moving his eyes and head back and forth to gauge the distance of the hole and the lie of the green. These movements, of course, cause the beam of light coming from the device of this invention to move in an erratic manner over the putting surface which movement the golfer would not pay attention to, but after completing his pre-putting practice, the golfer would assume a normal putting stance and hold his body stready. At this point, the golfer should notice the position of the beam of light which is focused on the putting surface near the ball. The golfer should then ignore the beam of light and concentrate on putting the golfball into the hole using his putting stroke. Once the ball is on the way to the hole, the golfer, without moving his head, should glance and note where on the putting surface the beam of light in now positioned. The distance between the first and second positions of the light indicates the degree to which the golfer has moved his head while putting. Through practice using the device of this invention, a golfer should be able to minimize or completely eliminate the distance between the original and second position of the beam of light so that eventually he will be able to putt consistently without moving his head.

It has been found best not to focus the beam of light directly on the golfball which focusing might distract the golfer. It is only necessary for the light to be focused reasonably near the golf ball, usually on the other side of it from the golfer.

DESCRIPTION OF THE PREFERRED EMBODIMENT(S)

Figure 1:
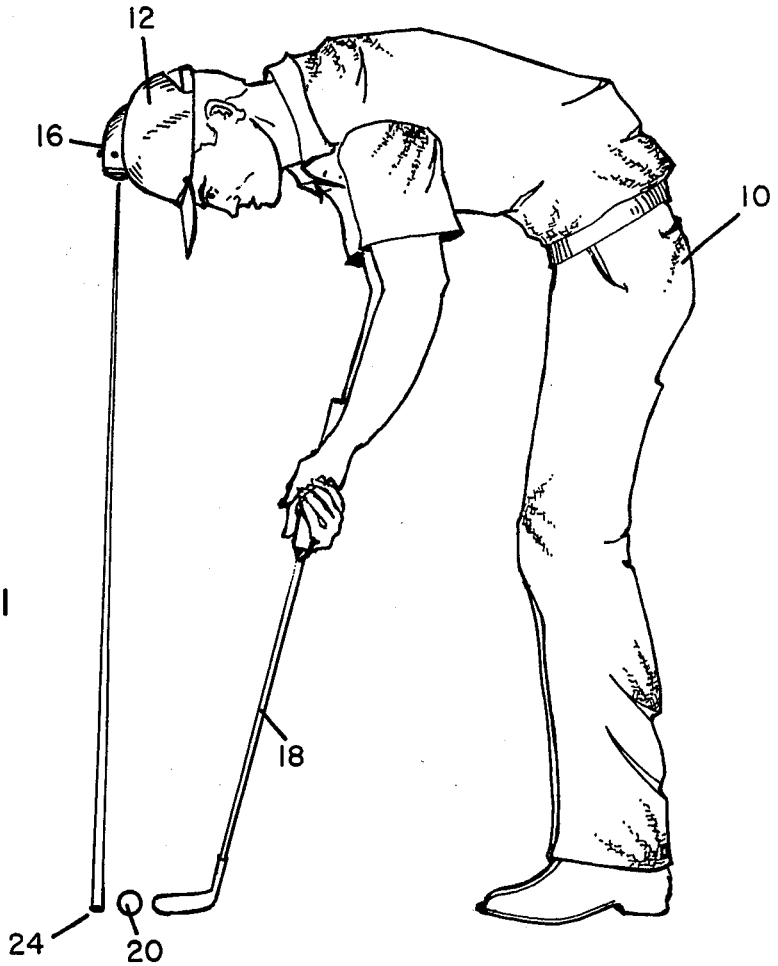
FIG. 1 shows a golfer using the device of this invention.

FIG. 1 illustrates a view of a golfer 10 in the process of putting golfball 20 with club 18. Golfer 10 is wearing golf cap 12. Seen in this view is light-emitting member 16 shining downward to a first spot 24 which the golfer observes at certain times during the putting process.

Figure 2:
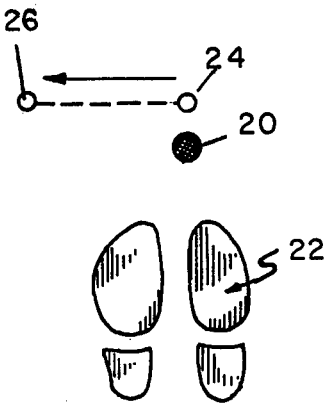
FIG. 2 illustrates the view downward from the putter's head toward his feet showing the golfball and spot beam of light in its original and second positions.

FIG. 2 illustrates the method of use wherein the foot area on which the golfer stands is depicted by area 22 and ball 20 is in position in front of the golfer. Light member 16 is shining on a first light position 24. When the golfer putts the ball, he should observe immediately after putting the second position of the light spot. If it is still in first position 24, then he has successfully prevented his head from moving during the putting process. But if he observes the light spot having moved, for example, to second light position 26, then he knows he has moved his head.

Figure 3:
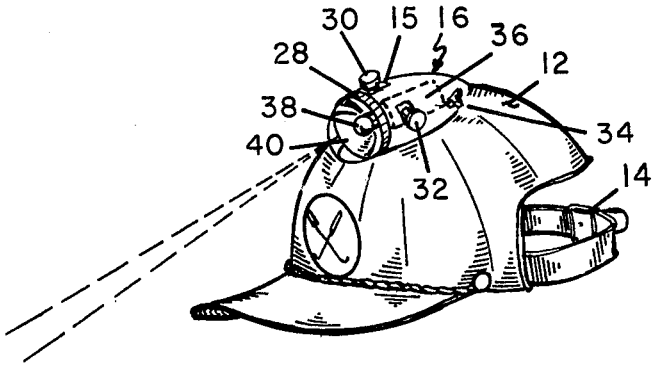
FIG. 3 shows the light-emitting golf cap of this invention.

FIG. 3 illustrates in detail the surface of this invention comprised of cap 12 having headban retention adjustment means 14 which can tighten on the head of golfer 10 in order to maintain the cap in position while the golfer is bending over. Cap retention adjustment means is necessary due to the additional weight of light member 16 on top of the cap which cap must be held securely in place to prevent it from falling off while being worn. Light member 16 contains an energy source 36 such as a battery. Switch 34 can be provided in order to activate or deactivate the light member. Bulb member 38 may be surrounded at its rear by a reflector member 40 and be covered by a transparent protective shield or lens member 28 which may rotate within a surrounding screw threaded portion of its casing to adjust the focus of the light spot to accommodate heights of different golfers. Position adjustmemt means 15 can include horizontal adjustment member 30 to rotate the reflector sideways for horizontal adjustment, and a vertical adjustment means 32 to rotate the reflector in an upward and downward fashion for vertical adjustment so that the spot may be moved by the golfer to a position that he is comfortable with near the ball. Position adjustment means 15 can also incorporate other types of adjustments, for example, having the bulb and reflector light assembly mounted on a ball and socket joint which can swivel with an electric wire attachment to the batteries mounted in another section of the cap.

Although the present invention has been described with reference to particular embodiments, it will be apparent to those skilled in the art that variations and modifications can be substituted therefor without departing from the principles and spirit of the invention.

I claim:

1. An improved method of preventing head movement of a golfer when putting a golfball comprising the steps of:

providing a cap member for a golfer to wear with light-emitting means to project a spot beam of light when said cap is worn;

projecting said spot beam of light from said light-emitting means in said cap to a first position in the vicinity of said golfball;

observing the position of said first light spot;

putting in a normal fashion while said golfer tries not to move his head; and observing the position of said light spot again to determine if said spot has moved from said first position to a second position.

* * * * *